United States Patent [19]

Huber et al.

[11] Patent Number: 4,582,968

[45] Date of Patent: Apr. 15, 1986

[54] NEEDLE THREAD-BREAK MONITOR FOR EMBROIDERY MACHINES

[75] Inventors: Kurt Huber, Arbon; Armin Kobler, Oberriet, both of Switzerland

[73] Assignee: Aktiengesellschaft Adolph Saurer, Arbon, Switzerland

[21] Appl. No.: 590,274

[22] Filed: Mar. 16, 1984

[30] Foreign Application Priority Data

Mar. 21, 1983 [CH] Switzerland ..... 1522/83

[51] Int. Cl.[4] ..... H01H 3/16

[52] U.S. Cl. ..... 200/61.18; 112/278; 139/354; 340/677

[58] Field of Search ..... 200/61.18; 340/677; 112/273, 278

[56] References Cited

U.S. PATENT DOCUMENTS 2,569,475 10/1951 Klein ..... 340/677 X 2,696,608 12/1954 Hangartner ..... 200/61.18 X

FOREIGN PATENT DOCUMENTS 193703 12/1957 Austria .

35795 12/1961 Switzerland .

*Primary Examiner*—Roy N. Envall, Jr.

*Assistant Examiner*—Morris Ginsburg

*Attorney, Agent, or Firm*—Werner W. Kleeman

[57] ABSTRACT

The needle thread-break monitor for embroidery machines comprises a double-armed rocking lever acting as a switch in an electrical circuit of an alarm system. The rocking lever is mounted on a bearing shaft forming one pole or terminal of the switch. The other pole or terminal of the switch is formed by a limit or abutment shaft arranged substantially vertically above and extending substantially parallel to the bearing shaft. The arm of the rocking lever not having a thread guide cooperates with the limit shaft, which carries a sleeve of electrically insulating material forming a stop limiting the open position of the switch. The arm of the rocking lever having a thread guide cooperates with the sleeve. The sleeve is rotatable between a terminal or limit position on the terminal or limit shaft enabling electrical contact and another limit position inhibiting electrical contact. The sleeve serves as a support for a needle thread in the relaxed or non-tensioned state. These measures permit the design of a simple yet reliable needle thread-break monitor which fulfills all requirements.

10 Claims, 4 Drawing Figures

31
19
14
40
ALARM SYSTEM
1
3
2
7
6
41
42
10
21
18
16
5
15
4
8
9

NEEDLE THREAD-BREAK MONITOR FOR EMBROIDERY MACHINES

BACKGROUND OF THE INVENTION

The present invention broadly relates to yarn or thread-break monitors and, more specifically, pertains to a new and improved construction of a needle thread-break monitor or stop motion for embroidery machines.

Generally speaking, the needle yarn or thread-break monitor or stop motion of the present invention is intended for use in embroidery machines and is of the type comprising a two-armed or double-armed pivot lever or rocker or rocking lever acting as a switch in an electrical or current circuit of an alarm system and being mounted on a bearing or support shaft forming one pole of the switch. The rocker or rocking lever is pivotable through an angle limited by stop or abutment means between a closed position and an open position of the switch. The stop or abutment means limiting the closed position of the switch forms the second pole or terminal of the switch. The rocker or pivot lever is held in the open position of the switch by a tensioned needle thread guided in a thread guide on the rocker lever.

Needle thread-break monitors or stop motions of this type are particularly employed in embroidery machines provided with a plurality of needles and serve to generate an electrical signal when a needle thread or yarn breaks, which signal may be an alarm signal or may serve to shut down the corresponding machinery.

A known needle thread-break monitor or stop motion is employed for this purpose in which a bearing shaft forming one pole or terminal of the electrical circuit is supported on a mounting rail or support forming the other pole or terminal of the switch through insulating means. Normally, such a bearing shaft is provided with a plurality of such switches in parallel. When a needle thread breaks, the corresponding rocking lever drops with its thread guide-carrying arm onto a contact edge of the mounting rail or support and closes the alarm circuit. An insulating sleeve is fitted to the contact arm of the rocking lever carrying the thread guide for rendering selected needle thread monitors inoperative. These insulating sleeves can be manually shifted into a contact-inhibiting position. The individual continuously tensioned needle threads are drawn from a thread supply and guided over a braking drum. A thread lifting or pick-up tube is arranged between the braking drum and the needle thread monitor mechanism to hold the needle threads up. This lifting tube simultaneously serves as a conduit for guiding the electrical conductors or lines to the bearing shaft and to the mounting rail or support.

Needle thread-break monitors of this known type have a number of considerable disadvantages. For instance, such needle thread-break monitors or stop motions have proven to be unusable for embroidering goods with metallized yarns, since this electrically conductive yarn short-circuits the electrical circuit of the alarm system if it touches the mounting rail or support forming one pole or terminal of the switch. Such contacts take place constantly due to yarn vibration.

The insulating sleeve mounted on the contact arm of the rocking lever for enabling or inhibiting electrical contact of the needle thread-break monitor or stop motion is unsatisfactory with respect to manipulation and security. Furthermore, a failure of the alarm system can arise when a shuttle thread breaks and a needle thread is not tightened by the thread supply and adheres to the braking drum and is held high enough by the thread lifting or pick-up tube that the rocking lever does not drop onto the mounting rail. Finally, in large embroidery machines having a plurality of switches next to one another, the rocking levers, which are not laterally guided on the bearing shaft, can migrate along the bearing shaft, which may lead to a diagonal or inclined feed of the embroidery threads.

SUMMARY OF THE INVENTION

Therefore, with the foregoing in mind, it is a primary object of the present invention to provide a new and improved construction of a needle thread-break monitor or stop motion which does not have associated with it the aforementioned drawbacks and shortcomings of prior art constructions.

Another important object of the present invention is to provide a needle thread-break monitor or stop motion of the character described which is constructed such that, while employing a simple design embodying very few components, there can be effectively avoided the aforementioned drawbacks of the state of the art needle thread-break monitors.

A further significant object of the present invention aims at providing a new and improved construction of a needle thread-break monitor or stop motion of the character described which is relatively simple in construction and design, extremely economical to manufacture, highly reliable in operation, not readily subject to breakdown and malfunction and requires a minimum of maintenance and servicing.

Now in order to implement these and still further objects of the invention, which will become more readily apparent as the description proceeds, the needle thread-break monitor or stop motion of the present invention is manifested by the features that:

- the stop or abutment means limiting the closed position and forming the other terminal of the switch comprises a limit or abutment shaft arranged substantially vertically above and substantially parallel to the bearing shaft and with which limit shaft there cooperates the arm of the rocker lever devoid of the thread guide;
- a sleeve of electrically insulating material is rotatably mounted on the limit shaft to form stop means defining or limiting the open position of the switch;
- the sleeve having a first limit or terminal position and a second limit or terminal position and being rotatable therebetween; and
- the sleeve supporting the thread in a relaxed or non-tensioned state thereof.

By means of the measure of employing the thread-guide free arm of the rocker or rocking lever for effecting electrical contact in cooperation with a limit or abutment shaft, the point of electrical contact can be moved further away from the thread guide and the needle thread in a downward and rearward direction. This prevents the closure of an electrical circuit between the limit shaft and the bearing shaft serving as the two poles of the switch of the alarm circuit by a "jumping" or oscillating thread.

Such short-circuiting is further prevented by the limit shaft being covered or protected by an insulating sleeve which leaves only as much of the outer surface of the limit shaft exposed as is required for a reliable contact with the thread-guide free arm of the rocking lever. This permits the use of metallized threads or yarns with no danger whatsoever of disturbance due to undesired electrical contacts.

Such a sleeve can also be readily used as a stop means limiting the open position of the switch with respect to the thread-guide carrying arm of the rocker or rocking lever and can also be easily and reliably rotated between a contact-enabling and a contact-inhibiting limit or terminal position on the limit shaft.

Furthermore, the arrangement of the present invention permits the omission of a thread lifting or pick-up tube holding the tightened needle threads up in relation to the current rail, so that even when a thread momentarily adheres to the braking drum, a pivoting of the rocking lever downward into the contact position is assured.

An advantageous embodiment of the invention which leaves a sufficient area of the outer surface of the limit or abutment shaft free for electrical contact is obtained by providing the insulating sleeve with a slit or longitudinal opening in the region of which the thread-guide free arm of the rocker or rocking lever contacts the limit shaft in the closed position of the switch, i.e. when the thread being guided by the thread guide of the rocking arm is relaxed, and when the sleeve is in the electrical contact-enabling limit position.

It is advantageous, both from the standpoint of manufacturing as well as of manipulation of the sleeve, if the slit or longitudinal opening of the sleeve is located substantially parallel to its lengthwise axis and extends over substantially the full width of the sleeve. Then the sleeve or sleeve member can comprise at least approximately half of a tube, i.e. a cylindrical shell, whose edges disposed parallel to the lengthwise axis define or limit the slit or longitudinal opening.

In a needle thread-monitor or stop motion in which the rocker or rocking lever is made of steel wire coiled to form a bearing aperture or eyelet between its two lever arms, one particularly advantageous embodiment provides the sleeve in the region of its end faces with substantially disk-shaped end flanges spaced apart from one another at a distance which is at least approximately equal to the width of the rocking lever. The disk-shaped end flanges each comprise two circumferential sectors of differing radii and forming steps. The steps or step structure form stop surfaces defining or limiting the limit or terminal positions of the sleeve on the limit shaft.

These measures make it possible to guide the rocking lever so as to be free of wandering tendencies or migration along the lengthwise axis of the bearing shaft. The end flanges also provide good accessibility of the sleeve when rotating it between the contact-enabling and the contact-inhibiting positions.

A further advantageous embodiment of the invention provides each flange in the region of the sector of smaller radius with a radial slot which opens into the axially parallel slit or opening of the sleeve in such manner that the sleeve can be pressed onto the limit or abutment shaft through the radial slot. This permits a simple replacement of the sleeves which is of considerable importance in machines having a large number of needles.

A simplified embodiment of the needle thread-break monitor or stop motion of the invention is obtained when the stop or abutment surfaces of the end flanges cooperate with the bearing shaft and the sectors of the end flanges having the greater radius form axial stops for the rocking lever.

It is also advantageous for the end flange sectors of smaller radius to just clear the limit shaft and, on at least one of the end flanges, to be provided with a radially protruding latch button or knob at a prescribed distance from the stop surfaces in order to latch the sleeve in the limit position. It is further advantageous to provide the latching buttons or knobs with an elastic support by forming an arc-shaped slot in the end flange sector of smaller radius.

A simple embodiment of the invention which is also suitable for converting or retrofitting existing embroidery machines is obtained by supporting the bearing shaft and the limit or abutment shaft on insulating supports mounted on a hollow mounting rail or support enclosing the electrical conductors or leads.

BRIEF DESCRIPTION OF THE DRAWINGS

The invention will be better understood and objects other than those set forth above, will become apparent when consideration is given to the following detailed description thereof wherein.

DETAILED DESCRIPTION OF THE PREFERRED EMBODIMENTS

Describing now the drawings, it is to be understood that to simplify the showing of the drawings only enough of the structure of the needle thread-break monitor or stop motion has been illustrated therein as is needed to enable one skilled in the art to readily understand the underlying principles and concepts of this invention. The illustrated exemplary embodiment of the needle thread-break monitor or stop motion for an embroidery machine, symbolically indicated by a section of the machine frame 30 and a so-called braking drum or roller 31, serves to close the electrical or current circuit of an alarm system 40 when a needle thread 19 breaks in order to generate a corresponding failure or fault signal.

Figure 1:
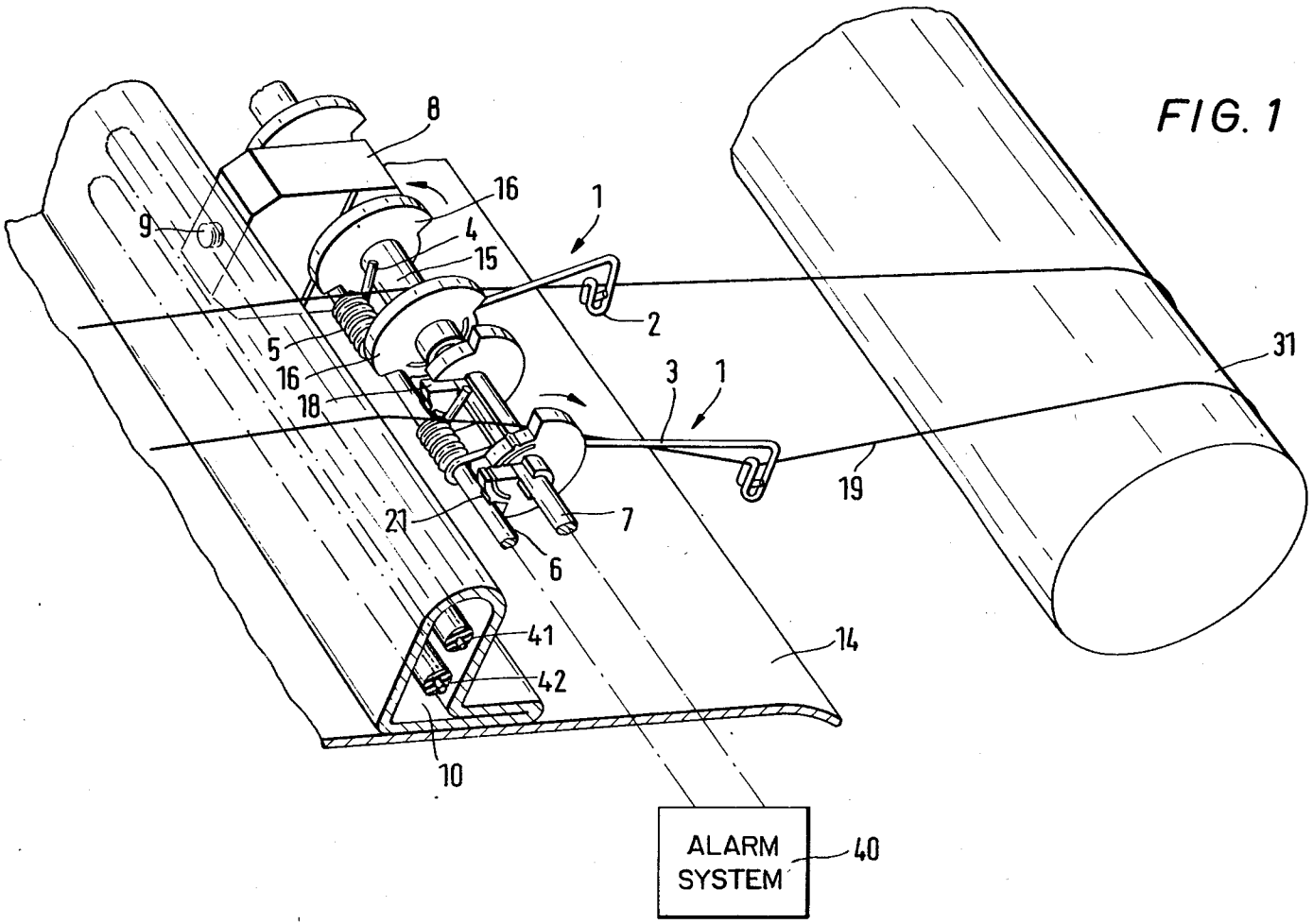
FIG. 1 is a schematic perspective view of the inventive needle thread-break monitor or stop motion applied to an embroidery machine having a plurality of needles.

Usually, such an embroidery machine comprises a plurality of needles not shown in the drawings and therefore also a corresponding plurality of needle thread-break monitors or stop motions for each needle thread. Such a multiple arrangement is indicated in FIG. 1. In such a case, all needle thread-break monitors or stop motions thereof have in common the bearing shaft or rod 6, the limit or abutment shaft 7, a mounting rail or support 10 and a protective plate 14 as well as the alarm system circuit arrangement or alarm means 40.

Each needle thread-break monitor or stop motion comprises a double-armed rocking or rocker lever 1 acting as a switch in the electrical circuit of the alarm means or system 40 which is mounted on the bearing shaft or rod 6 forming one pole of the switch. In the exemplary embodiment shown, the rocking or rocker lever 1, defining a pivoting lever, is made of a steel wire or the like and comprises a coiled portion 5 forming a bearing aperture or eyelet between its two opposite ends. A first, longer arm 3 of the rocking or rocker lever 1 is provided with a thread guide or eyelet 2 at its free end for guiding the corresponding needle thread 19 while the other or second, shorter arm 4 serves for making electrical contact with the limit shaft or rod 7, as will be described in more detail below.

The limit or abutment shaft 7 forms the other pole of the switch. It extends substantially parallel to the bearing shaft 6 at a given distance at least approximately vertically above this bearing shaft 6. Both the bearing shaft 6 and the limit shaft 7 are supported on a hollow profiled mounting rail or support 10 by means of insulating blocks or elements 8 and screw means 9. The hollow mounting rail or support 10 is fastened to the machine frame 30 by means of spacers 13 and screw means 12. The mounting rail or support 10 is preferably tubular or hollow and serves in the embodiment shown in the drawings as a protective conduit for the required electrical cables 41 and 42 or the like.

Figure 2:
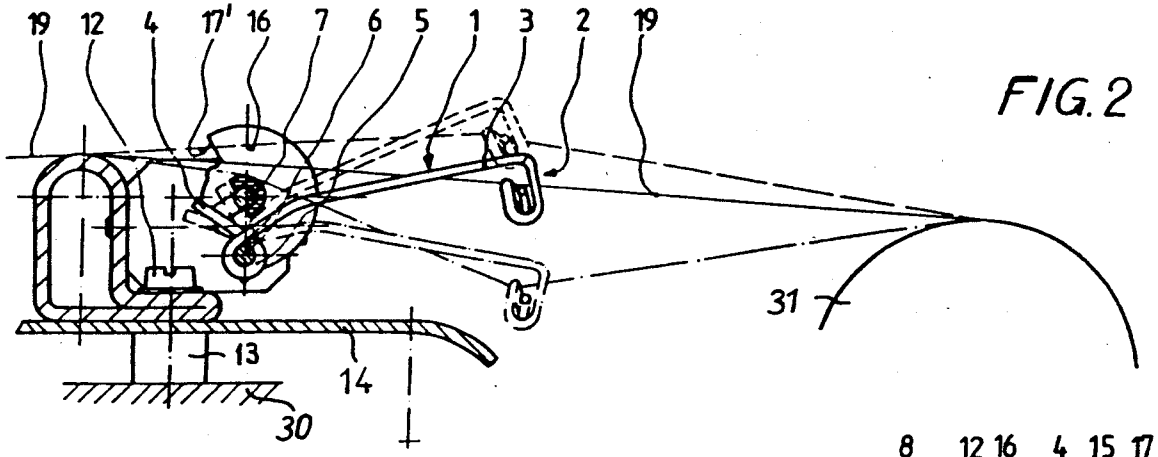
FIGS. 2 and 3 are cross-sectional views of the needle thread-break monitor of FIG. 1 in different states of operation.

The arrangement as described thus far is functional, although to a very limited extent. The needle thread 19 guided by the thread guide 2 holds the rocking lever 1 in the open position of the switch when the thread is under tension as is indicated in solid lines in FIG. 2. When a needle thread breaks, the rocking or rocker lever 1 drops, with a clockwise motion as seen in FIG. 2, and its thread-guide free arm 4 contacts the limit or abutment shaft 7 which closes the signal current circuit. This position is indicated in chain-dot or phantom lines in FIG. 2.

In order to be able to place the needle thread-break monitor or stop motion in a state in which electrical contact is inhibited and in order to prevent short-circuiting of the current-carrying limit shaft 7, e.g. by an oscillating thread, according to the invention a sleeve or sleeve member 15 formed of electrically insulating material is rotatably mounted on the limit shaft 7.

This sleeve 15 also limits the pivoting motion of the thread-guide carrying first lever arm 3 of the rocking lever 1 in the upward direction due to vibrations and the like, as is indicated in broken lines in FIG. 2.

The sleeve or sleeve member 15 comprises a slit or longitudinal opening 20 extending over substantially the full width of the sleeve 15 substantially parallel to its lengthwise axis and through which the thread-guide free second lever arm 4 of the rocking or rocker lever 1 can enter into electrical contact with the limit or abutment shaft 7 in the closed position of the switch, i.e. when a thread has broken, if the sleeve 15 has been rotated into a contact-enabling position (FIG. 2). Advantageously, in the embodiment shown in the drawings the sleeve 15 has the form of half of a tube, i.e. a cylindrical shell, whose edges located parallel to the lengthwise axis of the sleeve 15 define or limit the slit or longitudinal opening 20. As will be explained in more detail below, this particular configuration of the sleeve 15 has the advantage that such sleeve can be pressed onto the limit shaft 7 in a radial direction.

The sleeve 15 further comprises substantially disk-shaped end flanges 16 in the regions of both of its end faces and which are spaced apart by a distance at least approximately equal to the width of the rocking lever 1. The end flanges 16 each have two circumferential sectors of differing radii R and r (FIG. 4) which form steps where they meet. The steps or stepped portions 17 and 17' form stop surfaces or abutments which define or limit the positions of the sleeves 15 on the limit shaft 7.

Each end flange 16 comprises a radial slot or aperture 18 in the region of its circumferential sector of smaller radius r which opens into the axially parallel slit or longitudinal opening 20 of the sleeve 15 such that the sleeve 15, as mentioned above, can be press fitted or pressed onto the limit or abutment shaft 7 through these radial slots 18.

It will be seen from the drawings that the stop surfaces defined by the stepped portions or steps 17 and 17' on the end flanges 16 cooperate with the bearing shaft 6. The end flange sectors of larger radius R form axial stops or guides for the rocking or rocker lever 1. In the illustrative embodiment shown in the drawings the arrangement is designed such that the end flange sectors of smaller radius r just clear the bearing shaft 6 and are provided with, on at least one of the end flanges 16, a radially protruding latching button or knob 21 at a given distance from the stop surfaces defined by the stepped portions 17 and 17'.

Figure 3:
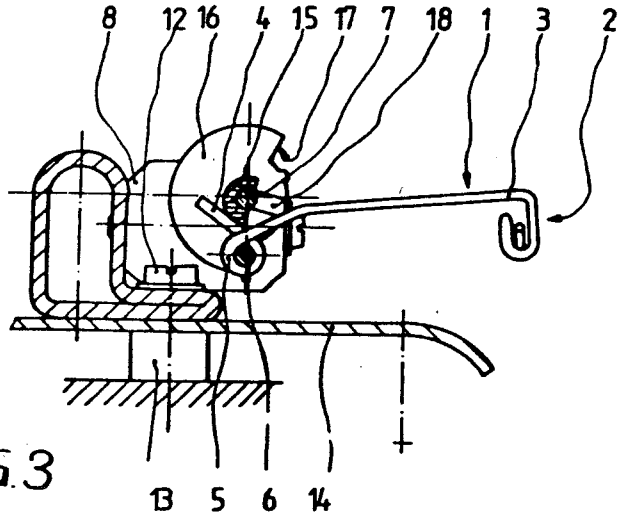
Figure 4:
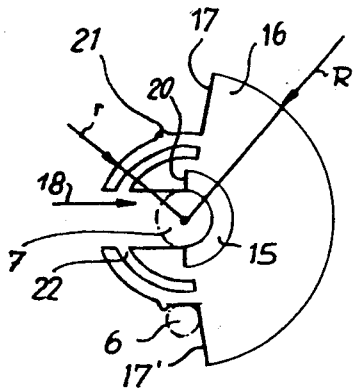
FIG. 4 shows an inventively significant detail of the arrangement of FIGS. 1 through 3 in side view and on an enlarged scale.

In the preferred embodiment of the sleeve 15 shown in FIG. 4, the latching buttons or knobs 21 are elastically supported on the end flange sector of smaller radius r by forming an arc-shaped slot 22 in the end flange. This embodiment permits a precise latching of the sleeves 15 in two different limit or terminal positions, one enabling electrical contact (FIG. 2) and the other inhibiting electrical contact (FIG. 3), without hindering the rotatability of the sleeve 15 between these limit or terminal positions.

It can easily be seen from the above description that the needle thread-break monitor or stop motion according to the invention is able to fulfill all of the previously mentioned conditions. In particular, by employing the limit or abutment shaft 7 for electrical contact with the thread-guide free second lever arm 4 of the rocking or rocker lever 1, the point of contact is moved further away from the thread guide 2 and the needle thread 19 in a downward and rearward direction, thus preventing the undesired contact of a "jumping" or oscillating thread with the current-carrying limit shaft 7. Such contact is further prevented by the limit shaft 7 being covered by the insulating sleeve or sleeve member 15 which leaves just as much of the outer surface of the limit or abutment shaft 7 free as is required for reliable electrical contact of the thread-guide free second lever arm 4 of the rocking lever 1. This permits the use of metallized threads or yarns with no danger whatsoever of undesired electrical contact or short-circuit. Furthermore, this sleeve or sleeve member 15 serves as a simple means of providing a stop for the thread guide carrying first lever arm 3 of the rocking lever 1 and limiting the open position of the switch, as was explained above. Furthermore, this sleeve 15 can readily and reliably be rotated between the contact-enabling and the contact-inhibiting limit or terminal positions on the limit shaft 7.

It will be understood that, apart from the illustrative exemplary embodiment of the needle thread-break monitor or stop motion according to the invention described above, a number of modifications are possible within the conceptual framework and teachings of the present invention. For instance, the above-described insulating sleeves 15 on the limit or abutment shaft 7 can be formed as cylindrical sleeves and comprise instead of the longitudinal slit 20 a radial slit of modest width through which the contact arm of the rocking or rocker lever 1 can enter into electrical contact with the current carrying limit shaft 7. In such an embodiment of the sleeves, the disk-shaped end flanges 16 can be formed without slots or apertures 18.

The above-described needle thread-break monitor or stop motion according to the invention also permits a very simple and reliable design and is well suited for converting or retrofitting existing embroidery machines of any kind.

While there are shown and described present preferred embodiments of the invention, it is to be distinctly understood that the invention is not limited thereto, but may be otherwise variously embodied and practiced within the scope of the following claims. ACCORDINGLY,

What we claim is:

1. A needle thread-break monitor for embroidery machines, comprising:

an electrical circuit including a switch and alarm means;

said switch of said electrical circuit being provided with a first contact pole and a second contact pole and having an open position and a closed position;

a bearing shaft forming said first contact pole of the switch;

a limit shaft arranged substantially vertically above and substantially parallel to said bearing shaft and forming a first stop means and said second pole of the switch;

at least one rocking lever defining the switch of the electrical circuit and having a first lever arm and a second lever arm;

said rocking lever being mounted on said bearing shaft to pivot through an angle between the open position of the switch and the closed position of the switch;

said first lever arm of the rocking lever having a thread guide for guiding a thread of the embroidery machine;

the thread having a tensioned state for closing an embroidery loop and a relaxed state for inserting a shuttle through an open embroidery loop;

the rocking lever being held in the open position of the switch in said tensioned state of the thread by the thread in the thread guide;

at least one sleeve of electrically insulating material being rotatably mounted on said limit shaft to form a second stop means limiting the open position of the switch;

said at least one sleeve having a first limit position and a second limit position and being rotatable therebetween;

said at least one sleeve in said first limit position cooperating with said second lever arm of the rocking lever to inhibit electrical contact thereof with the second contact pole of the switch in said relaxed state of the thread;

said at least one sleeve in said second limit position allowing the second lever arm of the rocking lever to cooperate with the limit shaft to effect electrical contact therebetween; and said at least one sleeve supporting the thread in said relaxed state thereof.

2. The needle thread-break monitor as defined in claim 1, wherein:

said at least one sleeve contains a longitudinal slit; and said second lever arm of the rocking lever entering into electrical contact with said limit shaft in the region of said longitudinal slit of said at least one sleeve when said at least one sleeve is in said second limit position thereof and in said relaxed state of the thread.

3. The needle thread-break monitor as defined in claim 2, wherein:

said at least one sleeve has a lengthwise axis; and said slit in said at least one sleeve extending substantially over the full width of said at least one sleeve substantially parallel to said lengthwise axis.

4. The needle thread-break monitor as defined in claim 3, wherein:

said at least one sleeve comprises at least approximately half of a tube;

said tube half having a lengthwise axis and edges extending substantially parallel thereto; and said edges limiting said slit.

5. The needle thread-break monitor as defined in claim 1, wherein:

said rocking lever is formed of steel wire coiled to define a bearing aperture between said first lever arm and said second lever arm;

said rocking lever having a predetermined width;

said at least one sleeve having two opposed end faces and comprising substantially disk-shaped end flanges in mutually spaced relationship in the region of each said two end faces;

said mutually spaced relationship corresponding at least approximately to said width of the rocking lever;

each of said end flanges having two circumferential sectors;

said two circumferential sectors of each of said end flanges having different radii and forming step means where they meet; and said step means forming stop surfaces respectively defining said first limit position and said second limit position of said at least one sleeve on said limit shaft.

6. The needle thread-break monitor as defined in claim 2, wherein:

said rocking lever is formed of steel wire coiled to define a bearing aperture between said first lever arm and said second lever arm;

said rocking lever having a predetermined width;

said at least one sleeve having two opposed end faces and comprising substantially disk-shaped end flanges in mutually spaced relationship in the region of each of said two end faces;

said mutually spaced relationship corresponding at least approximately to said width of the rocking lever;

each of said end flanges having two circumferential sectors;

said two circumferential sectors of each of said end flanges having different radii and forming step means where they meet;

said step means forming stop surfaces respectively defining said first limit position and said second limit position of said at least one sleeve on said limit shaft;

a first one of said radii of said two sectors of said end flanges of said at least one sleeve is a smaller radius and a second one is a larger radius;

said smaller radius being provided on a first one of said two sectors; and said first one of the two sectors comprising a radial slot opening into said longitudinal slit such that said at least one sleeve is capable of being pressed onto said limit shaft through said radial slot.

7. The needle thread-break monitor as defined in claim 5, wherein:

said stop surfaces of said end flanges cooperate with said bearing shaft;

a first one of said radii of said two circumferential sectors of said at least one sleeve is a smaller radius and a second one is a larger radius;

said larger radius being provided on a second one of said two circumferential sectors; and said second one of the two circumferential sectors forming an axial stop for said rocking lever.

8. The needle thread-break monitor as defined in claim 7, wherein:

said smaller radius being provided on a first one of said two circumferential sectors;

said first one of the two circumferential sectors of the end flanges just clearing said bearing shaft;

at least one of the end flanges comprising a radially protruding latch means; and said latch means having a prescribed spaced relationship to said stop surfaces.

9. The needle thread-break monitor as defined in claim 8, wherein:

said first one of said two circumferential sectors contains a substantially arc-shaped slot; and said latch means being formed on said first one of the two circumferential sectors and elastically supported thereby.

10. The needle thread-break monitor as defined in claim 1, comprising:

electrical cables of said electrical circuit;

a hollow profiled mounting rail forming a conduit for said electrical cables;

insulating blocks mounted on said mounting rail; and said bearing shaft and said limit shaft being mounted on said mounting rail by means of said insulating blocks.

* * * * *